US006766565B2

(12) United States Patent
Crye et al.

(10) Patent No.: US 6,766,565 B2
(45) Date of Patent: Jul. 27, 2004

(54) SELF-OPENING VENT AND POCKET SYSTEM

(75) Inventors: Caleb Clark Crye, Brooklyn, NY (US); Eric Owen Fehlberg, Queens, NY (US); Gregg M. Thompson, Brooklyn, NY (US)

(73) Assignee: LineWeight LLC, Brooklyn, NY (US)

( * ) Notice: Subject to any disclaimer, the term of this patent is extended or adjusted under 35 U.S.C. 154(b) by 19 days.

(21) Appl. No.: 10/252,728

(22) Filed: Sep. 23, 2002

(65) Prior Publication Data

US 2003/0074719 A1 Apr. 24, 2003

Related U.S. Application Data

(60) Provisional application No. 60/324,889, filed on Sep. 26, 2001.

(51) Int. Cl.[7] ..... A44B 19/00

(52) U.S. Cl. ..... 24/381; 24/398; 24/104; 24/306

(58) Field of Search ..... 24/104, 106, 107, 24/114.4, 114.05, 381, 388, 300, 413, 414, 435, 442; 2/49.2, 247–254, 263

(56) References Cited

U.S. PATENT DOCUMENTS

| | | | | | |
|---|---|---|---|---|---|
| 503,113 | A | * | 8/1893 | Osterloh | 383/34 |
| 1,339,799 | A | * | 5/1920 | Vom Elgen | 16/256 |
| 1,341,754 | A | * | 6/1920 | Lotz | 16/335 |
| 1,982,845 | A | * | 12/1934 | Wagman | 383/97 |
| 2,017,410 | A | * | 10/1935 | Hiering | 150/123 |
| 2,123,447 | A | * | 7/1938 | Waite | 2/48 |
| 2,142,764 | A | * | 1/1939 | Kluger | 383/34 |
| 2,158,955 | A | * | 5/1939 | Blacher | 24/30.5 R |
| 2,236,115 | A | * | 3/1941 | Schwartman | 206/283 |
| 2,241,612 | A | * | 5/1941 | Norris | 55/369 |
| 4,898,477 | A | | 2/1990 | Cox et al. | |
| 5,027,965 | A | | 7/1991 | Dumars | |
| 5,044,774 | A | | 9/1991 | Bullard et al. | |
| 5,174,658 | A | | 12/1992 | Cook et al. | |
| 5,184,896 | A | * | 2/1993 | Hammond et al. | 383/33 |
| 5,337,539 | A | * | 8/1994 | Barton | 53/413 |
| 5,354,132 | A | | 10/1994 | Young et al. | |
| 5,372,428 | A | * | 12/1994 | Bruno et al. | 383/5 |
| 5,647,670 | A | | 7/1997 | Iscovich | |
| 6,290,392 | B1 | | 9/2001 | Sandor | |
| 2003/0077007 | A1 | | 4/2003 | Turvey et al. | |

OTHER PUBLICATIONS

"Squeeze Coin Pouch by North Star" web page printout http://www.beltoutlet.com/squeezcoinpo.html dated Aug. 22, 2003.

* cited by examiner

*Primary Examiner*—Robert J. Sandy
*Assistant Examiner*—Ruth C. Rodriguez
(74) *Attorney, Agent, or Firm*—Stiennon & Stiennon

(57) ABSTRACT

A garment with a flexible fabric shell has a pocket or vent opening with a resealable closure such as a zipper, snaps, or hook and loop fasteners, which is operable between a closed position, in which the opening in the shell is closed, and an open position, in which the opening in the shell is revealed. A resilient spring member of springy plastic, composite, metal or other material is mounted to the fabric around the opening, and has two arms which have portions which are displaced vertically from one another when the closure is open, but which are resiliently compressed into a common plane when the closure is sealed. Each time the closure is opened, the spring member urges portions of the shell on either side of the flap apart, to thereby enlarge the area of the opening and permit access or air flow therethrough.

13 Claims, 3 Drawing Sheets

SELF-OPENING VENT AND POCKET SYSTEM

CROSS REFERENCES TO RELATED APPLICATIONS

This application claims the benefit of the filing date of U.S. Provisional Application No. 60/324,889, filed Sep. 26, 2001, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

Adjustable garments can be a great aid to human effectiveness, particularly in performing complicated or strenuous activities outdoors. Strategically placed pockets can make important supplies and accessories readily available in a convenient location for the wearer of the garment. Moreover, zippered vent openings in thermally important positions can provide ventilation on demand to rapidly reduce the temperatures within the garment during periods of heavy exertion, or, alternatively to maintain temperatures when the wearer is at rest.

Pockets and vent openings are closed with conventional fasteners such as zippers, snaps, string ties, and hook and loop fastening systems. However, depending on the location of the opening, the disposition of the wearer's limbs, the stance of the wearer, wind conditions, etc., the openings, once the fasteners have been released, may be of greater or lesser size. If the side flaps of the opening remain adjacent one another, air passage therethrough may be restricted in the case of a vent, or access to the contents may be cumbersome in the case of a pocket.

What is needed is a reclosable opening which may reliably present a definite passageway once it has been unsealed.

SUMMARY OF THE INVENTION

The closure system of the present invention has a spring member with two arms spaced on opposite sides of the slit opening of a pocket or ventilation opening, formed, for example, in a garment. The spring member is formed of a resilient material such as nylon. In its undeformed condition, the spring member arms are curved above and below the plane of the flexible fabric containing the opening. When the closure, be it zipper, snaps, buttons, hook and loop fasteners, or otherwise, is closed, the spring force of the spring member is overcome, and the pocket or ventilation opening is closed in a conventional fashion. When the closure is opened, the restorative force of the spring member arms causes the flaps on opposing sides of the opening to spread apart. The spring member may be U-shaped or a closed loop, and it may be fastened to the fabric to surround the closure, or may be formed as a part of the closure and attached to the fabric. The wide opening of the mouth facilitates air flow through a ventilation opening, and one-handed unobstructed access to contents of a pocket.

It is an object of the present invention to provide a pocket which has a wide mouth when it is opened.

It is another object of the present invention to provide a ventilation opening in a garment with a wide surface area when opened, despite the orientation or posture of the garment's wearer.

Further objects, features and advantages of the invention will be apparent from the following detailed description when taken in conjunction with the accompanying drawings.

DESCRIPTION OF THE PREFERRED EMBODIMENTS

Figure 1:
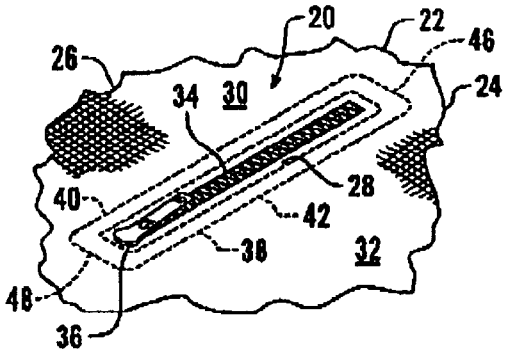
FIG. 1 is a fragmentary isometric view of a garment having the closure assembly of this invention, with the closure in a closed position.
Figure 2:
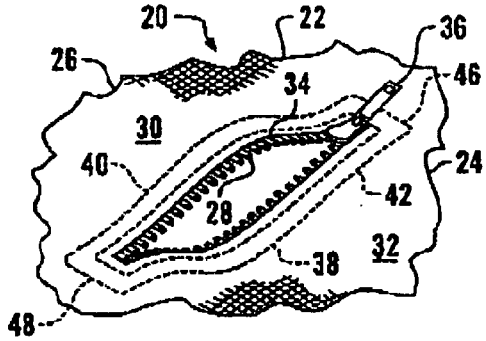
FIG. 2 is a fragmentary isometric view of the garment of FIG. 1 with the closure assembly in an open position.

Referring more particularly to FIGS. 1–8, wherein like numbers refer to similar parts, a closure assembly 20 is shown in FIGS. 1 and 2. The closure assembly 20 may be used to resealably cover a pocket or air vent in a garment 22, such as the one shown in FIG. 8, or in a backpack, luggage, accessory, or other device into which ready access is desired. The closure assembly 20 is fixed to the flexible fabric substrate 24 of the item to which it is mounted, for example the shell 26 of the garment 22. As shown in FIG. 2, the fabric substrate 24 has a slit opening 28 which divides a first side flap 30 from a second side flap 32. A closure 34 such as a zipper, one or more snaps, ties, buttons, or hook and loop fasteners, is secured between the first side flap 30 and the second side flap 32. The closure 34 itself operates in a conventional fashion. The illustrated zipper closure is opened by grasping the zipper pull 36 and advancing from one end of the closure to the other.

A spring member 38 is mounted to the fabric substrate 24 to surround the closure 34. The spring member 38 is formed of a resilient material such as thin nylon, urethane, or metal, for example a wire, spring steel or other springy material. The spring member 38 has a first arm 40 which is connected to the first side flap 30 and a second arm 42 which is parallel to the first arm and which is connected to the second side flap 32. The spring member 38 may be attached to the fabric substrate 24 by sewing, adhesive, heat staking, grommets, or other conventional fastening means. The closure 34 may be fixed to the fabric substrate 24 separately from the spring member by similar or different fastening means. The first arm 40 is connected to the second arm 42 by a first connecting section 46 and a second connecting section 48. The connecting sections 46, 48 lie in approximately a common plane and space the first arm and the second arm from each other on opposite sides of the opening 28. The spring member 38 thus is in a looped shape, in an interior opening which coincides with the opening in the garment.

As shown in FIG. 2, the spring member 38 is molded or heat formed so that, when the closure is opened, the first arm 40 is curved to extend above the plane of the connecting sections 46, 48, while the second arm 42 is curved to extend below the plane of the connecting sections 46, 48. In other words, if a first direction is defined extending from the first arm across the opening to the second arm, the first arm will have portions which extend perpendicular to this first direction, while the second arm portions will also extend perpendicular to the first direction but opposite the direction of projection of the first arm.

As shown in FIG. 1, when the closure is sealed by moving the zipper pull 36 to the closed position, the arms 40, 42 of the spring member are deflected or distorted into approximately the same plane as the connecting sections 46, 48. When closed, therefore, the closure assembly 20 looks little different from a conventional zippered pocket. Once opened, however, the inherent resilience of the spring member causes the arms 40, 42 to seek to return to their original displaced positions and to thereby enforce a defined gap between the first side flap 30 and the second side flap 32. In other words, in a relaxed condition, when the closure is open, the first arm has portions which extend away from the second arm to define a first area between the first arm and the second arm, and in the deformed condition imposed upon the spring member by the sealing of the closure, these portions of the first arm and the second arm are brought substantially closer together such that an area defined between the first arm and the second arm is substantially smaller than the first area. Thus, the opening 28 is discrete and is not dependent on the wearer or the position of the garment on the wearer. This is particularly helpful for facilitating air flow through a vent opening or ready access of articles stored within a pocket.

Figure 3:
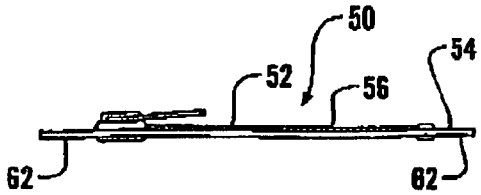
FIG. 3 is a side elevational view of an alternative embodiment closure assembly of this invention in which a zipper is formed in one piece with a spring member, the closure assembly being shown in a closed position.
Figure 4:
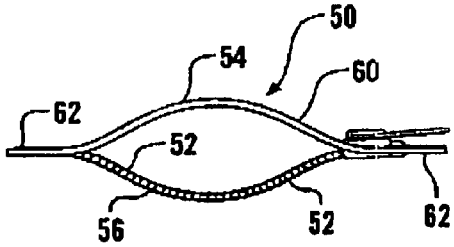
FIG. 4 is a side elevational view of the closure assembly of FIG. 3 in an open position.

An alternative embodiment closure assembly 50 is shown in FIGS. 3–4. The closure assembly 50 is illustrated prior to its attachment to the flexible fabric of a garment for clarity. The closure assembly 50 has the closure 52 integrally formed with or fixedly attached to a spring member 54. For example, the teeth 56 of a zipper closure 52 may be molded as part of the spring member 54. The spring member 54 has a first arm 58 spaced from a second arm 60 by two connecting sections 62. As shown in FIG. 4, the first arm 58 is a narrow strip of plastic material, for example, approximately 1/16 inch thick, which projects downwardly and has an upwardly opening concave curvature. The second arm 60 projects upwardly and has a convex curvature.

Figure 5:
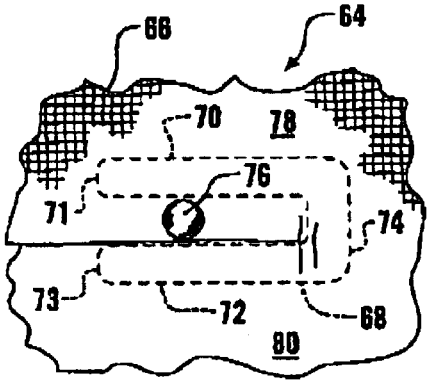
FIG. 5 is a top plan view of an alternative embodiment closure assembly of this invention mounted on a garment, the closure assembly being shown in a closed position.
Figure 6:
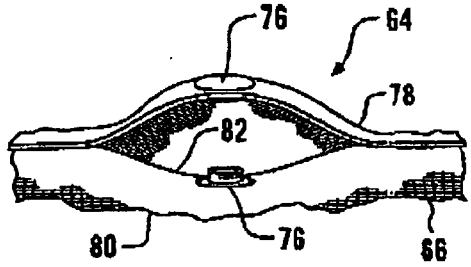
FIG. 6 is a side elevational view of the closure assembly of FIG. 5 in an open position.

As shown in FIGS. 5–6, a closure assembly 64 may be formed in a flexible fabric substrate 66 with a spring member 68 which is approximately U-shaped. As shown in FIG. 5, the spring member 68 has a first arm 70 with a first free end 71, and a second arm 72 with a second free end 73. The arms 70, 72 are connected by only a single connecting section 74 which is opposite the free ends 71, 73 of the arms. The closure 76 may be a conventional snap assembly with one part of the snap affixed to a first side flap 78 of the substrate 66 and the second part of the snap affixed to a second side flap 80. It should be noted that as in the case of snap fasteners, certain closures will have the first side flap 78 overlapping the second side flap 80 when the closure is in the closed position. The opening 80 is defined between the two side flaps 78, 80.

Figure 7:
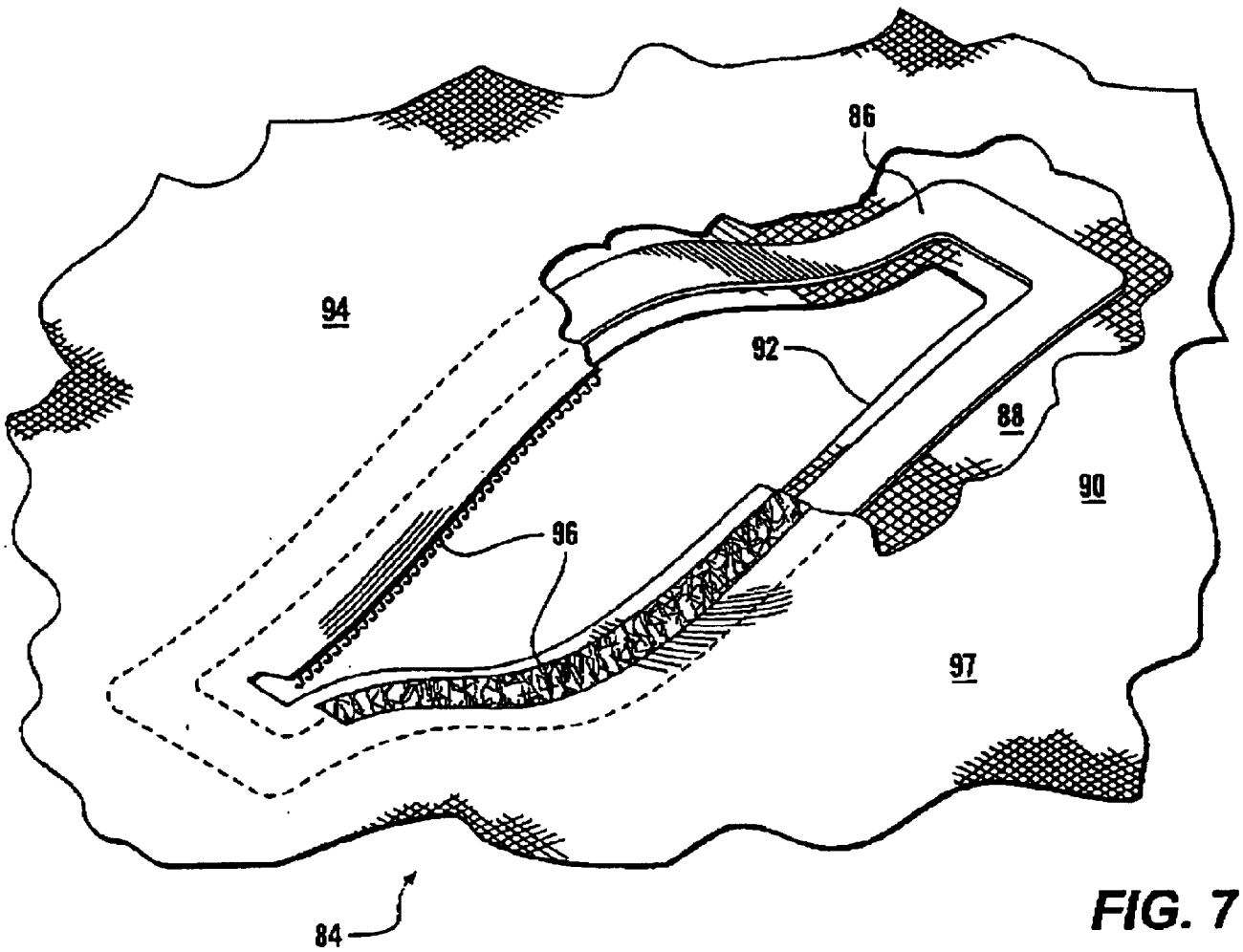
FIG. 7 is an isometric view of an alternative closure assembly of this invention, partially broken away in section, and employing a hook and loop fastener closure.
Figure 8:
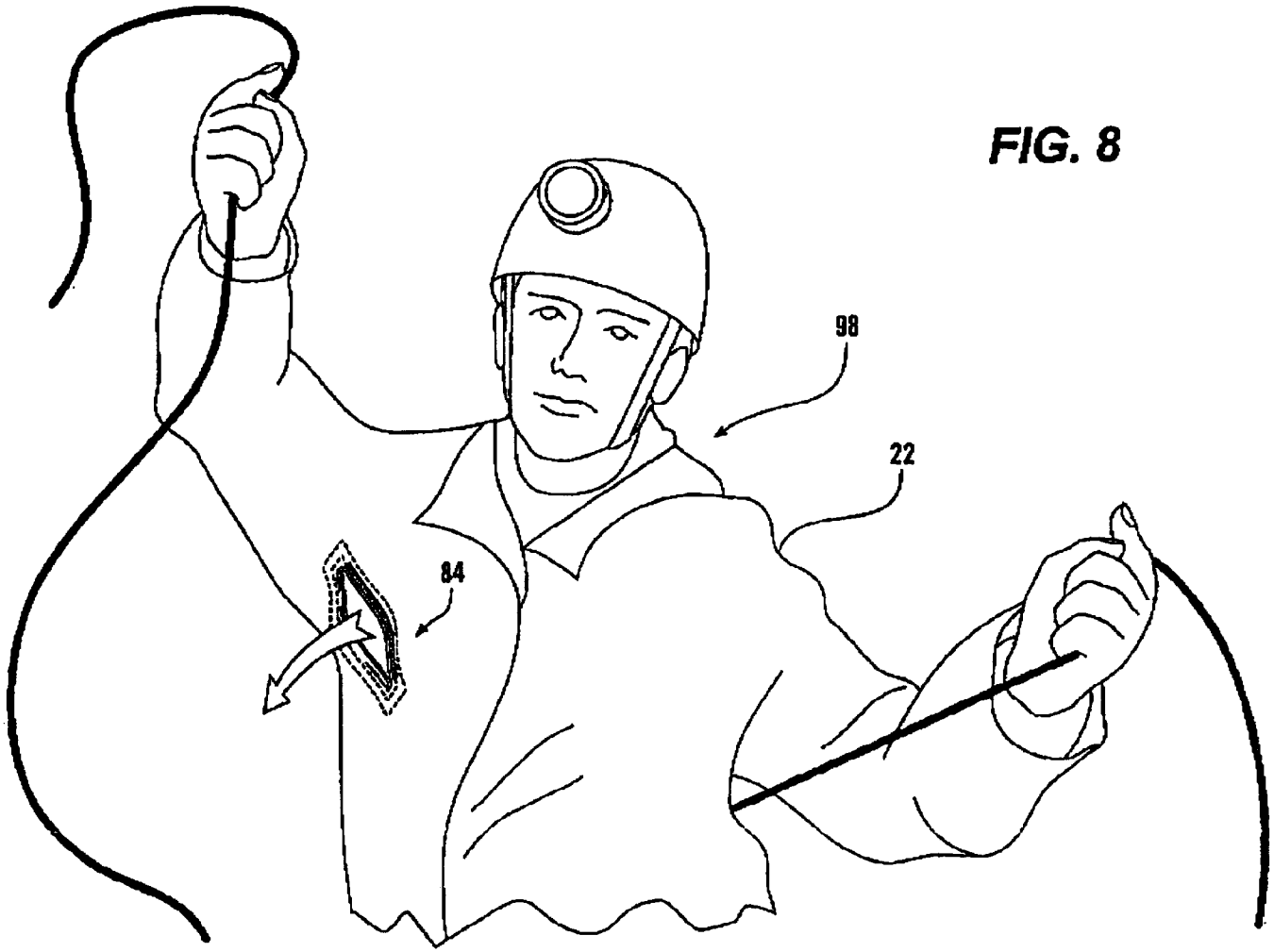
FIG. 8 is a perspective view of a garment of this invention having a hook and loop fastener closure with the spring member of this invention.

As shown in FIG. 7 and FIG. 8, a closure assembly 84 may employ a closure 96 formed of opposed strips of hook and loop fastener, such as VELCRO® fastener manufactured by Velcro Industries B.V. The closure assembly 84 has a spring member 86 which is sewn between an inner layer 88 of flexible fabric material and an outside layer 90 of flexible fabric material surrounding an opening 92 in the garment 22. One part of the hook and loop fastener is affixed to the first side flap 94 while the other part is affixed to the second side flap 97. The gripping strength of the hook and loop fastener as well as the spring force of the spring member 86 are selected such that the closure 96 will remain closed until intervention by the wearer. As shown in FIG. 8, a person 98 engaged in strenuous activity may open the closure 96 on the garment 22 with the result that the spring member will retain portions of the first side flap 94 spaced above the second side flap 97 with a lens shaped opening 100 defined therebetween.

It should be noted that the spring members of the closure assemblies may have other shapes than those illustrated, for example having multiple curves on each arm along a particularly wide pocket opening. In addition, the spring members may have a variety of cross-sectional shapes, for example having a circular cross section when formed of wire or spring steel.

It is understood that the invention is not limited to the particular construction and arrangement of parts herein illustrated and described, but embraces all such modified forms thereof.

We claim:

1. A closure assembly comprising:

a flexible substrate having a first side flap opposed to a second side flap along an opening, the opening extending in a first direction;

a resealable closure having portions affixed to the first side flap, and portions affixed to the second side flap, the closure being operable between a first closed position, in which the opening in the substrate is closed, and a second open position, in which the opening in the substrate is revealed;

a spring member mounted to the substrate, the spring member having a first arm which is connected to the first side flap and a second arm which is connected to the second side flap, the spring member first arm being spaced in a second direction across the opening from the second arm, and connected to the second arm by a first connecting section, wherein the spring member is resilient, wherein a first plane is defined by the first direction and the second direction, and wherein the spring member is formed such that portions of the first arm are spaced from portions of the second arm in a direction perpendicular to the first plane when the spring member is undeformed, and when the closure is in the closed position, the first arm is brought into approximately the same plane as the second arm, such that the spring member urges portions of the first flap away from portions of the second flap in a direction perpendicular to the first plane when the closure is in the second open position.

2. The closure assembly of claim 1 wherein the spring member first arm has a free end spaced from the first connecting section, and the spring member second arm has a free end spaced from the first connecting section.

3. The closure assembly of claim 1 wherein the spring member has a second connecting section spaced from the first connecting section, and the first arm and the second arm extend between the first connecting section and the second connecting section.

4. The closure assembly of claim 1 wherein the closure is integrally formed with the spring member.

5. The closure assembly of claim 1 wherein the closure is fixed to the flexible substrate, and the spring member is separately fixed to the flexible substrate.

6. The closure assembly of claim 1 wherein the closure is selected from the group consisting of a zipper, at least one snap fastener, at least one button, at least one tie, and a hook and loop fastener.

7. A closure assembly comprising:

a flexible substrate having a first side flap opposed to a second side flap along an opening;

a resealable closure having portions affixed to the first side flap, and portions affixed to the second side flap, the closure being operable between a first closed position, in which the opening in the substrate is closed, and a second open position, in which the opening in the substrate is revealed, wherein in the first closed position, a first plane extends parallel to the closure, the first flap, and the second flap, and wherein portions of the first flap are spaced from the second flap in the first plane; and a resilient spring member having a first arm connected to a second arm by a connecting section, the first arm being engaged with the first side flap, and the second arm being engaged with the second side flap, wherein the connecting section extends substantially in the first plane, and wherein in a relaxed condition, the first arm has portions which extend upwardly from the connecting section to be spaced above the first plane, and the second arm has portions which extend downwardly from the connecting section to be spaced below the first plane, and wherein in a deformed condition imposed upon the spring member by the sealing of the closure, the first arm and the second arm extend approximately in the first plane.

8. A closure assembly comprising:

a flexible substrate having a first side flap opposed to a second side flap along an opening;

a resealable closure having portions affixed to the first side flap, and portions affixed to the second side flap, the closure being operable between a first closed position, in which the opening in the substrate is closed, and a second open position, in which the opening in the substrate is revealed, wherein in the first closed position, a first plane extends parallel to the closure, the first flap, and the second flap, and wherein a first direction is defined in the first plane extending from the first flap to the second flap; and a resilient spring member having a first arm connected to a second arm by a connecting section, wherein the first arm is fixed to the first side flap, and the second arm is fixed to the second side flap, and the connecting section spaces the second arm from the first arm in the first direction, and wherein in a relaxed condition, the first arm has portions which extend away from the second arm to be spaced above the first plane, and the second arm has portions which extend below the first plane, and wherein in a deformed condition imposed upon the spring member by the sealing of the closure, said portions of the first arm and the second arm are brought substantially closer together.

9. The closure assembly of claim 8 wherein the spring member first arm has a free end spaced from the first connecting section, and the spring member second arm has a free end spaced from the first connecting section.

10. The closure assembly of claim 8 wherein the spring member has a second connecting section spaced from the first connecting section, and the first arm and the second arm extend between the first connecting section and the second connecting section.

11. The closure assembly of claim 8 wherein the closure is integrally formed with the spring member.

12. The closure assembly of claim 8 wherein the closure is fixed to the flexible substrate, and the spring member is separately fixed to the flexible substrate.

13. The closure assembly of claim 8 wherein the closure is selected from the group consisting of a zipper, at least one snap fastener, at least one button, at least one tie, and a hook and loop fastener.

* * * * *